US010612540B2

(12) United States Patent
DeCanio

(10) Patent No.: US 10,612,540 B2
(45) Date of Patent: Apr. 7, 2020

(54) PUMP GLAND WELL SHIELD

(71) Applicant: Paul Joseph DeCanio, Brentwood, NY (US)

(72) Inventor: Paul Joseph DeCanio, Brentwood, NY (US)

( * ) Notice: Subject to any disclaimer, the term of this patent is extended or adjusted under 35 U.S.C. 154(b) by 146 days.

(21) Appl. No.: 15/898,593

(22) Filed: Feb. 18, 2018

(65) Prior Publication Data

US 2019/0257307 A1 Aug. 22, 2019

(51) Int. Cl.
*F04B 53/16* (2006.01)
*F04B 53/18* (2006.01)

(52) U.S. Cl.
CPC ..... *F04B 53/16* (2013.01); *F04B 53/18* (2013.01)

(58) Field of Classification Search
CPC ..... F04B 53/164; F04B 53/16; B65D 5/18; B65D 5/3614; B65D 5/3607; B65D 71/22; G09F 2013/0468; G09F 2013/0481
USPC ..... 150/157
See application file for complete search history.

(56) References Cited

U.S. PATENT DOCUMENTS 1,565,620 A * 12/1925 Brigham ..... F04B 53/00 92/153
2,655,870 A * 10/1953 Yohpe ..... F04B 1/00 417/568
3,259,908 A * 7/1966 Simpson ..... A61F 9/025 2/9
2011/0084071 A1* 4/2011 Gundersen ..... A47G 19/26 220/252

* cited by examiner

*Primary Examiner* — Daniel J Colilla

(57) ABSTRACT

A device for shielding pump gland wells which permits visual access to the pump gland components. The device includes and not limited to a rectangular body structure (1) comprising of a flexible material having at both ends narrow sections (2) with stop flange sections (3), a window section (7) with a clear member (5) permanently held in place by pop rivets (4) and washers (6) having a fastening means by the elasticity of the body structure (1) to compress to form a u-shape and install with biased tension by pressing the narrow sections (2) into the inner circumferential surface of the gland well (9) which installation is complete when contact between the stop flange section (3) with the gland well (9) top edge. The device maybe made of a clear flexible material and further comprising of other shapes which will produce the equivalent result.

3 Claims, 1 Drawing Sheet

PUMP GLAND WELL SHIELD

BACKGROUND OF THE INVENTION

Field of the Invention

The invention relates generally to a device that safely shields pump gland wells and allows visual access to the pump gland components.

Description of the Prior Art

Pumps are used to transfer liquid from one location to another and are classified into two groups: positive and non-positive displacement pumps. In order to reduce leakage around the pump shaft where it passes through the casing, compression or jam type packing is used in the stuffing boxes which does not stop leakage entirely, it only throttles down the liquid. A slight leakage is needed to lubricate the shaft and packing. This leakage of liquid collects in the gland well and flows down the drain line. A problem that occurs is that pump gland wells are left open which in the dynamic mode the leaking liquid sprays off the pump shaft do to centrifugal force which causes a safety hazard for the operator and equipment. Also, excessive grease from the inboard and outboard bearings can spray off the shaft. In the statical mode leakage can spray out of stuffing box packing gland and become air born. This invention eliminates these problems.

SUMMARY OF THE INVENTION

The invention relates to a device that shields a pump gland well and allows full visual access to the packing gland components. besides the advantages of the pump gland well shield as described, several objects and advantages of the invention are to provide:

(a) safety for the pump operator from packing gland leakage and dislodged bearing grease.
(b) fast access to the pump gland components, such as packing gland adjustments and pump gland well drain.
(c) protection for plant equipment and from the environment from chemical and physical hazards of the liquid which is pumped.
(d) a device that is self-contained and requires no maintenance.
(e) a shield that can self-adjust to different pumps.
(f) a shield that has a removably fastening means.
(g) a shield that has a means of keeping the device in the proper installed mode.
(h) a shield that permits visual access while the pump is in dynamic or statical modes.
(i) a shield that is easily manufactured.

Further objects and advantages are to provide a pump gland well shield which can be used easily and conveniently to shield a pump gland well without causing damage to the gland well, is simple to install and inexpensive to manufacture, which can be manufactured and marketed as a separate unit so as to be installed on existing pumps or manufactured as an integral part of the pump, which can be used repeatedly, and which obviates the need to modify the pump gland well. Still further objects and advantages will become apparent from consideration of the following description and drawings.

DESCRIPTION OF THE PREFERRED EMBODIMENT

Figure 1:
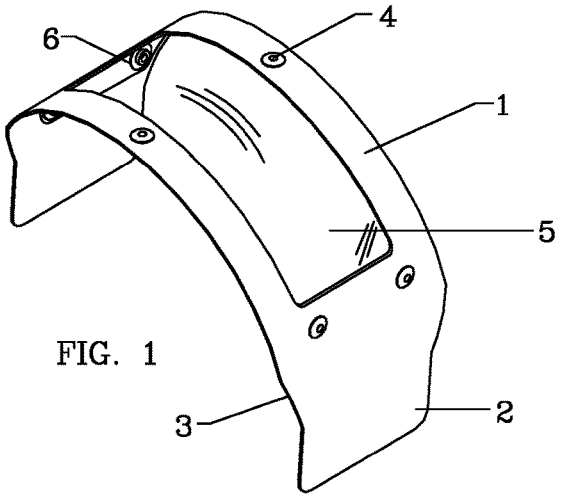
FIG. 1 is an elevation view showing an embodiment of the pump gland well shield.
Figure 2:
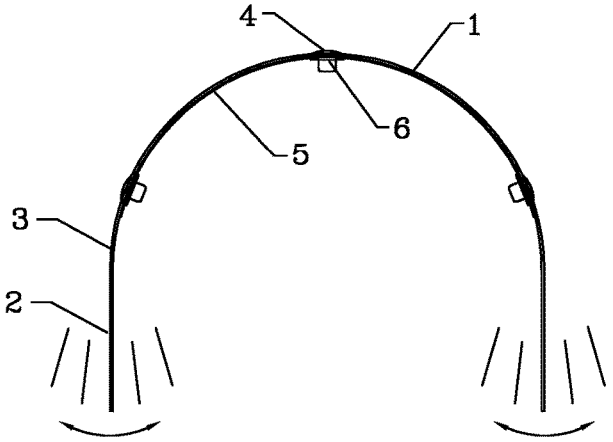
FIG. 2 is a front view showing an embodiment of the pump gland well shield.
Figure 3:
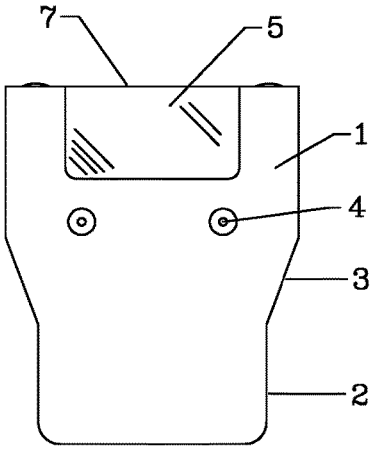
FIG. 3 is a side view showing an embodiment of the pump gland well shield.
Figure 4:
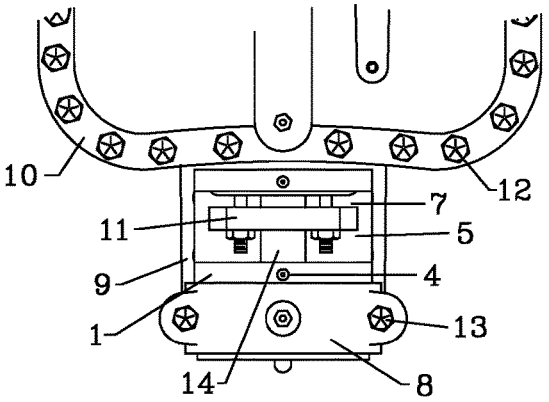
FIG. 4 is a top view showing yet another embodiment of the pump gland well shield installed to the outboard gland well.

An embodiment of the present invention is illustrated in FIGS. 1, 2 and 3. The shield which comprises of a thin body structure 1 consisting of a flexible, spring material can be repeatedly bent and straightened out without fracturing. Additionally, the shield is adapted to yieldingly engage the pump well gland of various size pumps. The body structure 1 having a rectangular shape forming at the longitudinal ends: a narrow section 2, an angular stop flange section 3, and a window section 7 having a clear member 5 held in place by rivets 4 and washers 6.

In this embodiment a fastening means which is shown as elasticity of the body structure 1 is compressed to form a u-shape and installed into the pump outboard bearing 8 pump gland well 9 by pressing the narrow section 2 therein the inner circumferential surface of the gland well 9 which installation is complete when contact of the stop flange section 3 makes contact with the gland well 9 top edge and the outer surface of the body structure 1 communicates with the inner circumferential surface of the pump gland well 9 and allows continuous bias tension to hold the shield in place which permits visual access to the pump packing gland 11 components such as the packing gland 11 bolts, pump shaft 14 and pump gland well 9 drain while properly shielding from the pump cover 10 to the outboard bearing 8.

It is to be understood that while the detailed drawings and specific examples given describe a preferred embodiment of the invention, it is for the purpose of illustration only, that the apparatus of the invention is not limited to the precise details and conditions disclosed and that various changes may be made therein without departing from the spirit of the invention. For example, the body structure 1 can be made of a clear flexible material which would not have a need for a window section 7, rivets 4, and rivet washers 6, and the body structure can be installed to inboard or outboard gland wells.

As another example the body structure can be fastened to the bearing bolts 13, pump cover bolts 12 or packing gland 11 bolts and have a living hinge which would allow the shield to be opened toward the outboard bearing 8 or to the pump cover 10 of various size pumps.

As another example the angular stop flange section 3 can be of a square shape and allow for the stop flange 3 to be bent outward perpendicular to the body structure 1 and make contact with the pump gland well 9 top edge. Thus the scope of the invention should be determined by the appended claims and their legal equivalents, rather than the examples given.

I claim:

1. A pump gland well shield for shielding a pump gland well, said pump gland well shield comprising:

a body structure which is a thin flat rectangular shape,
wherein said body structure includes a narrow section at opposite longitudinal ends of said body structure;
a window section located in a longitudinal center and lateral center of said body structure;

an angular stop flange section located between said window section and each narrow section of said body structure, wherein the pump gland well shield is configured to fit into various size pump gland wells for shielding any spraying liquid therein properly; and said body structure is made of a flexible, spring material wherein a clear member made of a clear flexible material is fastened to an underside of the body structure by rivets with washers, wherein said clear member covers the window section for visual access to any components located in the pump gland well.

2. The pump gland well shield according to claim 1, wherein said pump gland well shield is maintenance free and permits pump maintenance as well as repairs in dynamic or statical modes, of a pump.

3. A device as recited in claim 1 or 2, wherein said body structure is configured to bend to a U-like shape, and configured to be inserted, when in the bent U-like configuration, into an inner circumferential surface of the pump gland well such that the narrow sections of the body structure engage with said inner circumferential surface of the pump gland well, wherein installation is complete when the angular stop flanges each make contact with a top edge surface of the said pump gland well wherein a continuous bias tension holds the pump gland well shield in place, and wherein said pump gland well shield self-adjusting to yieldingly engage with various size pumps or different types of pumps.

* * * * *